US005564978A

United States Patent [19]

Jones et al.

[11] Patent Number: 5,564,978

[45] Date of Patent: Oct. 15, 1996

[54] APPARATUS AND METHOD FOR TERMINATING COIN SORTING USING PRESSURELESS EXIT CHANNELS AND IMMEDIATE STOPPING

[75] Inventors: John E. Jones, Winnetka; James M. Rasmussen, Chicago, both of Ill.

[73] Assignee: Cummins-Allison Corp., Mt. Prospect, Ill.

[21] Appl. No.: 542,960

[22] Filed: Oct. 13, 1995

Related U.S. Application Data

[63] Continuation of Ser. No. 127,791, Sep. 28, 1993, Pat. No. 5,514,034, and a division of Ser. No. 336,416, Nov. 9, 1994, Pat. No. 5,474,497.

[51] Int. Cl.[6] ..... G07D 3/06

[52] U.S. Cl. ..... 453/17; 453/57

[58] Field of Search ..... 453/6, 10, 12, 453/17, 29, 30, 32, 57, 58; 188/158, 162

[56] References Cited

U.S. PATENT DOCUMENTS

| | | |
|---|---|---|
| 2,109,658 | 11/1932 | Zierick . |
| 2,378,828 | 6/1945 | Buchholz et al. . |
| 2,642,881 | 6/1953 | Buchholz . |
| 2,642,882 | 6/1953 | Buchholz . |
| 2,675,008 | 4/1954 | Buchholz et al. . |
| 2,675,009 | 4/1954 | Buchholz . |
| 2,679,849 | 6/1954 | Buchholz . |
| 2,835,260 | 5/1958 | Buchholz . |
| 2,906,276 | 9/1959 | Blanchette et al. . |
| 2,977,961 | 12/1957 | Buchholz et al. . |
| 3,016,191 | 1/1962 | Buchholz et al. . |
| 3,026,982 | 3/1962 | Buchholz et al. . |
| 3,246,658 | 4/1966 | Buchholz et al. . |
| 3,795,252 | 3/1974 | Black . |
| 4,086,928 | 5/1978 | Ristvedt et al. . |
| 4,098,280 | 7/1978 | Ristvedt . |
| 4,234,003 | 11/1980 | Ristvedt et al. . |
| 4,444,212 | 4/1984 | Ristvedt et al. . |
| 4,506,685 | 3/1985 | Childers et al. . |
| 4,531,531 | 7/1985 | Johnson et al. . |
| 4,543,969 | 10/1985 | Rasmussen . |
| 4,549,561 | 10/1985 | Johnson . |
| 4,557,282 | 12/1985 | Childers et al. . |
| 4,564,036 | 1/1986 | Ristvedt . |
| 4,564,037 | 1/1986 | Childers et al. . |
| 4,570,655 | 2/1986 | Raterman . |
| 4,586,522 | 5/1986 | Taipale et al. . |
| 4,607,649 | 8/1986 | Taipale et al. . |
| 4,620,559 | 11/1986 | Childers et al. . |
| 4,681,128 | 7/1987 | Ristvedt et al. . |
| 4,731,043 | 3/1988 | Ristvedt et al. . |
| 4,753,624 | 6/1988 | Adams et al. . |
| 4,775,353 | 10/1988 | Childers et al. . |
| 4,775,354 | 10/1988 | Rasmussen et al. . |
| 4,863,414 | 9/1989 | Ristvedt et al. . |
| 4,921,463 | 5/1990 | Primdahl et al. . |
| 4,966,570 | 10/1990 | Ristvedt et al. . |
| 4,988,860 | 1/1991 | Wollet et al. . |
| 5,009,627 | 4/1991 | Rasmussen . |
| 5,011,455 | 4/1991 | Rasmussen . |
| 5,022,889 | 6/1991 | Ristvedt et al. . |
| 5,026,320 | 6/1991 | Rasmussen . |
| 5,055,086 | 10/1991 | Raterman et al. ..... 453/10 |
| 5,106,338 | 4/1992 | Rasmussen et al. . |
| 5,123,873 | 6/1992 | Rasmussen . |
| 5,135,433 | 8/1992 | Watanabe et al. . |
| 5,141,443 | 8/1992 | Rasmussen . |
| 5,197,919 | 3/1993 | Geib et al. . |

FOREIGN PATENT DOCUMENTS

| | | |
|---|---|---|
| 1181726 | 1/1985 | Canada . |
| 0125132 | 11/1984 | European Pat. Off. . |
| 0138449 | 4/1985 | European Pat. Off. . |
| 0149906 | 7/1985 | European Pat. Off. . |
| 0151776 | 8/1985 | European Pat. Off. . |
| 0136774 | 10/1985 | European Pat. Off. . |
| 2515837 | 10/1975 | Germany . |
| 2614560 | 10/1977 | Germany . |
| 908999 | 10/1962 | United Kingdom . |

*Primary Examiner*—Karen Merritt
*Assistant Examiner*—Scott L. Lowe
*Attorney, Agent, or Firm*—Arnold, White & Durkee

[57] ABSTRACT

The present invention is a coin sorter apparatus for sorting a group of mixed coins by denomination and immediately terminating the sorting process in response to a predetermined operating condition, such as the filling of a coin receptacle with a predetermined number of coins. Sorting is provided by a stationary sorting head and a rotatable disc positioned sufficiently proximate to one another so that when the group of mixed coins are dropped into the center opening of the stationary sorting head, they are rotated by the rotating disc and guided by the sorting head on a outward spiral sorting path to exit channels along the periphery of the stationary sorting head. Each of the exit channels acts as an exit chute for a particular coin denomination by releasing pressure on that particular coin and freeing the coin to move outwardly along the exit channel and exit into a coin receptacle. At the moment of the predetermined operating condition, a braking mechanism immediately stops the rotation of the rotatable disc, and the coins within an exit channel exit through the exit channel due to the inertia of the coins.

2 Claims, 6 Drawing Sheets

APPARATUS AND METHOD FOR TERMINATING COIN SORTING USING PRESSURELESS EXIT CHANNELS AND IMMEDIATE STOPPING

This application is a continuation of application Ser. No. 08/127,791, filed Sep. 28, 1993, now U.S. Pat. No. 5,514,034, issued May 7, 1996, and its divisional application Ser. No. 08/336,416, filed Nov. 9, 1994, now U.S. Pat. 5,474,497, issued Dec. 12, 1995.

FIELD OF THE INVENTION

The present invention generally relates to an apparatus and method for sorting coins of different denominations. More particularly, the present invention relates to an apparatus and method for sorting coins of different denominations that utilizes pressureless exit channels and immediate stopping when a predetermined number of coins of a selected denomination have been ejected from the sorter.

BACKGROUND OF THE INVENTION

Today, coin sorters encounter the problem of "overage." Overage occurs when a coin sorter exceeds a predetermined number of coins of a certain denomination to be sorted. For instance, it is desirable for coin sorters to fill coin receptacles with a predetermined number of coins of a particular denomination to make the counting of coins less laborious. The coin sorter should stop the sorting process once a coin receptacle is filled with the proper number of coins. Unfortunately, coin sorters will frequently eject additional coins before the sorting process is terminated, leading to coin "overage." Various techniques have been developed to tackle the "overage" problem, but these techniques introduce additional costs. Thus, a simple and inexpensive yet accurate coin sorting apparatus is required that reduces coin "overage" to a tolerable level.

SUMMARY OF THE INVENTION

It is the primary object of the present invention to provide a relatively simple and inexpensive coin sorter mechanism which is capable of accurately sorting and counting coins at a high speed without excessive coin overage by immediately stopping the rotating disk when a predetermined number of coins of a certain denomination have been ejected from the coin sorter apparatus and permitting coins within pressureless exit channels to exit the coin sorting mechanism as a result of the inertia on those coins.

It is also an object of the present invention to provide a coin sorter apparatus which can be safely left unattended without any danger of excessive coin overage.

It is another object of the present invention to provide a coin sorter apparatus that reduces wear and the inaccuracies and potential for missorts introduced by coin sorters utilizing pressurized exit channels.

It is still another object of the present invention to provide a coin sorter apparatus which immediately stops the rotating disc in a simple and reliable manner in response to a predetermined condition that can be represented by an electrical signal.

Other objects and advantages of the present invention will be apparent from the following detailed description.

Accordingly, the foregoing objectives are realized by providing a coin sorter which includes a rotatable disc, a drive motor for rotating the disc, and a stationary sorting head having a lower surface parallel to the upper surface of the rotatable disc and spaced slightly therefrom. When a group of mixed coins is dropped into a central opening of the stationary sorting head, the coins are carried by the rotating disc and guided by the stationary sorting head on a outward spiral sorting path to exit channels along the periphery of the stationary sorting head. Each of thee exit channels acts as an exit chute for a particular coin denomination by releasing pressure on that particular coin and freeing the coin to move outwardly within the exit channel to exit into a coin receptacle. The use of pressureless exit channels reduces the potential for missorts present in coin sorters utilizing pressurized exit channels and reduces wear on the rotating disc and the exit channels of the stationary disc. At the moment of a predetermined operating condition, such as the filling of a coin receptacle with a predetermined number of coins, a braking mechanism immediately stops the rotation of the rotating disc, and some of the coins within an exit channel are discharged from the exit channel due to the inertia on those coins, preventing an unacceptable number of coin overruns.

In a preferred embodiment of the present invention, a series of sensors are preferably positioned at the periphery of the stationary sorting head proximate to the opening for each exit channel for sensing coins leaving the exit channels. Counters, responsive to the sensors, keep accurate count of the sorted coins in each receptacle. The counters along with additional sensing mechanisms provide signals indicating the presence of a predetermined condition, such as the filling of a coin receptacle with a predetermined number of coins. A braking mechanism immediately stops the rotating disc in response to these signals. Thus, the present invention prevents excessive overruns by immediately stopping the rotating disc and permitting the coins within the pressureless exit channels to exit the coin sorter apparatus due to the inertia of the coins and helps to prevent certain inaccuracies and wear present in coin sorters using pressurized exit channels.

BRIEF DESCRIPTION OF THE DRAWINGS

The advantages of the present invention will become apparent upon reading the following detailed description and upon reference to the accompanying drawings, in which.

Figure 1:
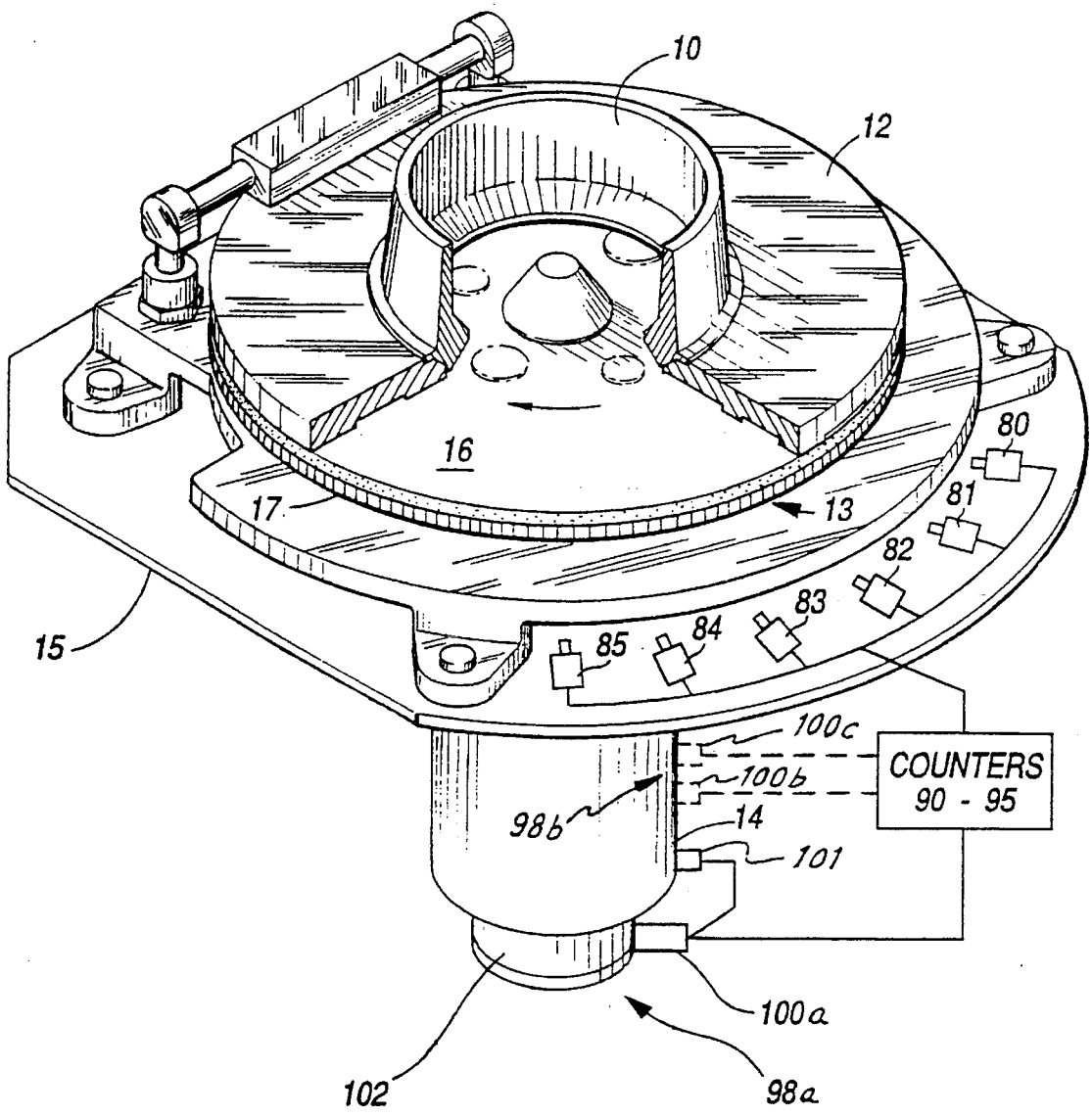
FIG. 1 is perspective view of a coin sorter embodying the present invention, with portions thereof broken away to show the internal structure.

While the invention is susceptible to various modifications and alternative forms, specific embodiments thereof have been shown by way of example in the drawings and will herein be described in detail. It should be understood, however, that it is not intended to limit the invention to the particular forms disclosed. On the contrary, the intention is to cover all modifications, equivalents, and alternatives falling within the spirit and scope of the invention as defined by the appended claims.

DETAILED DESCRIPTION OF THE PREFERRED EMBODIMENT

Turning now to the drawings and referring first to FIG. 1, a hopper 10 receives coins of mixed denominations and feeds them through a central feed aperture or opening in an annular sorting head or guide plate 12. As the coins pass through the central opening, they are deposited on the top surface of a rotatable disc 13. This disc 13 is mounted for rotation on a stub shaft (not shown) and driven by an electric AC or DC motor 14 attached to a mounting plate 15. The disc 13 comprises a resilient pad 16, preferably made of a resilient rubber or polymeric material, bonded to the top surface of a solid metal disc 17.

As the disc 13 is rotated, the coins deposited on the top surface thereof tend to slide outwardly over the surface of the pad 16 due to centrifugal and frictional forces. As the coins move outwardly, those coins which are lying flat on the pad 16 enter the gap between the pad surface and the sorting head 12 because the underside of the inner periphery of the sorting head is spaced above the pad 16 by a distance which is approximately as great as the thickness of the thickest coin. As further described below, the coins are sorted into their respective denominations, and the coins for each denomination issue from a respective exit channel, such as the channels 20, 21, 22, 23, 24 and 25 of FIG. 2. The particular embodiment illustrated in FIG. 2 was specifically designed for handling six United States coins, i.e., dimes, pennies, nickels, quarters, dollars and half-dollars, respectively.

In general, the coins for any given currency are sorted by the variation in diameter for the various denominations, although in many cases it is desirable or necessary to also sort by variation in thickness. The coins circulate between the sorting head and the rotating disc until a single-file stream of coins is obtained. One edge of the coins in this stream of coins is aligned, and possibly adjusted, so that the other edge of the coins is subsequently gaged against gaging surfaces for directing the coins to the exit channels 20–25 for the respective denominations.

Figure 2:
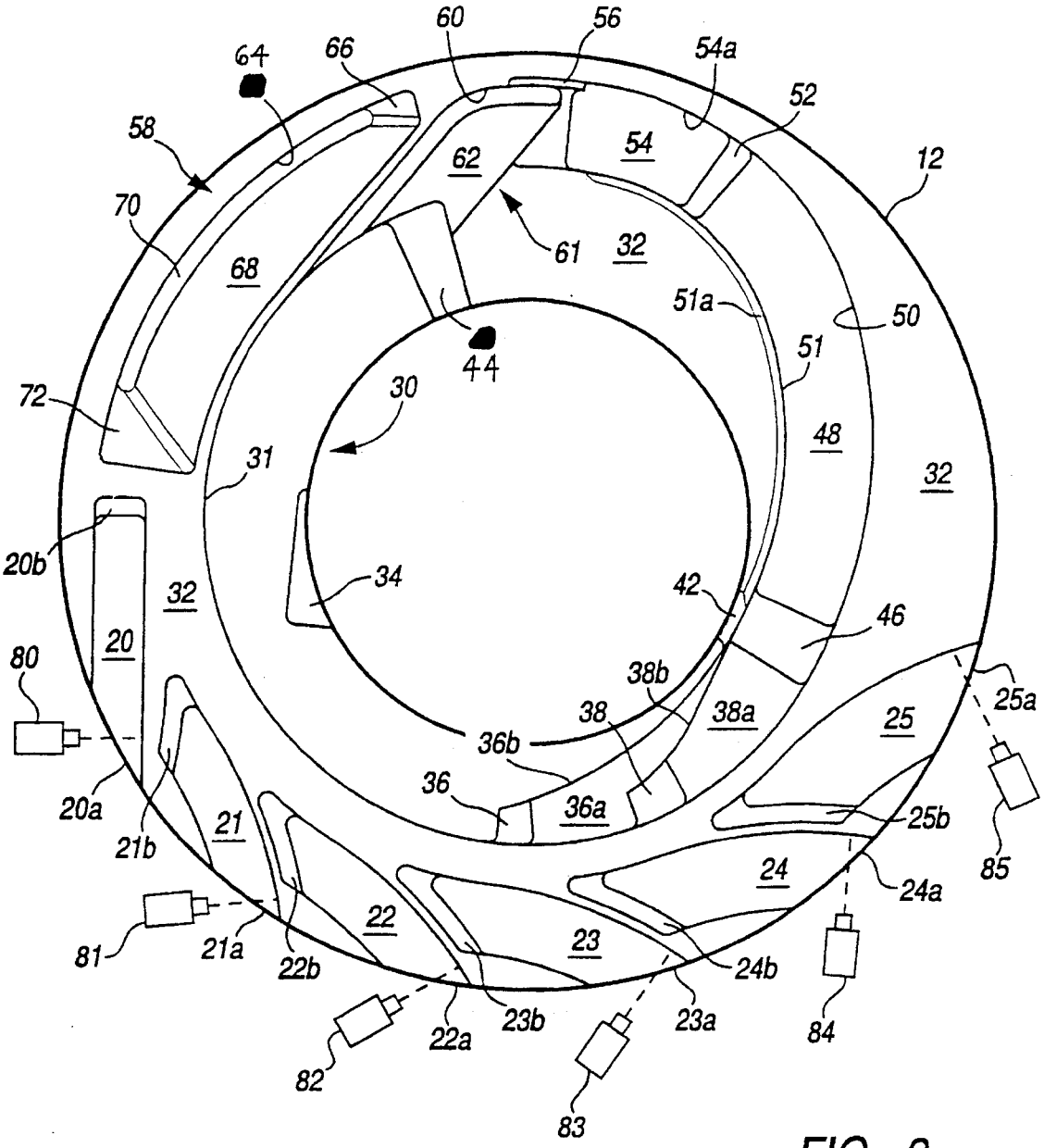
FIG. 2 is an enlarged bottom plan view of the sorting head or guide plate in the coin sorter of FIG. 1.

As can be seen most clearly in FIG. 2, the outwardly moving coins initially enter the entry channel 30 formed in the underside of the sorting head 12 from the central opening 40. It should be kept in mind that the circulation of the coins, which is clockwise in FIG. 1, appears counter-clockwise in FIG. 2 because FIG. 2 is a bottom view. A stripping notch 34 is illustrated for stripping "shingled" or "double" coins. The outer wall 31 of the entry channel 30 extends downwardly to the lowermost surface 32 of the sorting head 12, which is preferably spaced from the top surface of the pad 16 by a distance which is slightly less than the thickness of the thinnest coins. Consequently, the initial outward movement of the coins is terminated when they engage the wall 31 of the entry channel 30, though the coins continue to move circumferentially along the wall 31 by the rotational movement of the pad 16.

As the disc 13 rotates, coins in the entry channel 30 that are close enough to the wall 31 engage a ramp 36 leading down to surface 36*a*. A wall 36*b* defines an inner border for the surface 36*a* and extends in an inward arc to a ramp 42 leading down to the lowermost surface 32. The wall 36*b* tends to strip "shingled" or "double " coins. Preferably, the wall 36*b* separates the top coin of a pair of "shingled" or "double" coins and guides the top coin towards the ramp 42 for recirculation. Misaligned coins that miss the ramp 36 also require recirculation. The misaligned or stripped top coins engage the wall 36*b*, and the wall 36*b* guides these coins to the ramp 42. These coins move down the ramp 42 to the lowermost surface 32, and, as the coins move down the ramp 42, the coins are pressed into the pad 16. Once in a pressed engagement with the pad 16, these coins remain in the same radial position but move circumferentially along the surface 32 until engaging recirculation ramp 44. The recirculation ramp 44 leads back up into the entry channel 30 and recirculates the misaligned or stripped coins back into the entry channel 30.

Those coins that reach the surface 36*a* move circumferentially on the surface 36*a*, and, similarly, those coins close enough to the wall 31 engage a ramp 38 leading down to a surface 38*a*. A wall 38*b* defines the inner border of the surface 38*a* and extends in an inward arc to the ramp 42. The wall 38*b* provides another coin stripping mechanism to reduce "shingled" or "double" coins. As described above for the wall 36*b*, misaligned or stripped coins engage the wall 38*b*, and the wall 38*b* guides these coins to the ramp 42 for recirculation.

The coins that reach the surface 38*a* continue moving circumferentially along the surface 38*a* due to the rotation of the rotating disc 13 and encounter a ramp 46 leading up to a queuing channel 48. An outer wall 50 of the queuing channel 48 extends downwardly to the lowermost surface 32 of the sorting head 12. An inner wall 51 of the queuing channel 48 tends to reduce "shingled" or "double" coins within the queuing channel 48. The inner wall 51 extends downward less than the thickness of the thinnest coin to engage the top coin of "shingled" or "double" coins. For example, in the queuing channel 48, "double" or "shingled" coins are under pad pressure and tend to remain in their radial position. As such, as the "double" or "shingled" coins move circumferentially and maintain their radial position, the inner wall 51 engages the top coin of the "shingled" or "double" coins, tending to separate the coins. While the inner wall 51 separates the coins, the lower coin engages a beveled surface 51*a*, and, once separated, the lower coin is still under pad pressure with the beveled surface 51*a*. Consequently, the lower coin retains its radial position while moving circumferentially with the pad 16 and passes under the beveled surface 51*a* to the lowermost surface 32 for recirculation.

In the queuing channel 48, the coins can be pressed into engagement with the sorting head 12. This pad pressure on the coins is sometimes referred to as positive control. If the coins are free from positive control, the coins are free to move outwardly until the coins engage the wall 50 of the queuing channel 48 as the coins continue to move circumferentially due to the rotational movement of the pad 16. If the coins are under positive control, however, the coins maintain their radial position while continuing to move circumferentially along the queuing channel 48 due to the rotational movement of the pad 16.

As the coins move circumferentially along the queuing channel 48, the coins under positive control in the queuing channel 48 encounter a ramp 52 leading up into a deep channel 54. The deep channel 54 releases positive control on any thick coins that were under positive control in the queuing channel 48 and, thereby, unable to move outwardly to engage the wall 50 of the queuing channel 48. Therefore, as these coins enter the deep channel 54, the coins are permitted to move outwardly and desirably engage an outside wall 54*a* of the deep channel 54. The wall 50 of the queuing channel 48 blends into the wall 54*a* of the deep channel 54. After the coins enter the deep channel 54, the coins are desirably in a single-file stream of coins directed against the outer wall 54*a* of the deep channel 54.

The outer wall 54*a* guides the stream of coins to a narrow ramp 56. As the coins move circumferentially along the outer wall 54*a*, the coins engage the narrow ramp 56 leading down to the lowermost surface 32 of the sorting head 12. At the terminal end of the ramp 56, the coins are firmly pressed into the pad 16. As such, the coins are under positive control. Therefore, the radial position of the coins is maintained as the coins move circumferentially towards a gaging channel 58.

If any coins in the stream of coins leading up to the narrow ramp 56 is not sufficiently close to the wall 54*a* so as to engage the narrow ramp 56, then the misaligned coins engage an outer wall 60 of a recirculating channel 61. The recirculating channel 61 includes a beveled surface 62 that is slightly angled (e.g., 5¼ degrees) with respect to the pad surface. Such a beveled surface 62 allows misaligned coins to ramp away from pressed engagement with the pad 16. When the leading edges of the misaligned coins hit wall 60, the wall 60 guides the misaligned coins back to the entry channel 30 for recirculation.

It can occur that correctly aligned coins passing under the recirculating channel 61 as the coins move circumferentially towards the gaging channel 58 can be slightly shifted in their radial position. To correct this, coins which pass under the recirculating channel 61 encounter a ramp 66 leading into the gaging channel 58. The coins remain under pressure in the gaging channel 58, but the gaging channel 58 tends to urge the coins to be realigned against an outer gaging wall 64 of the gaging channel 58. The gaging channel 58 and the gaging wall 64 allow the coins in the sorting path an opportunity to realign their outer edges at the radial position required for correct sorting. To ensure that every coin engages the wall 64, the radius of the gaging wall 64 from the center of the disc is gradually decreased along the length of the gaging channel 58.

The gaging channel 58 preferably includes a beveled surface 68 that angles upward with respect to the pad surface and towards the gaging wall 64 and a deep surface 70. The coins moving into the gaging channel 58 remain under pressure from the sorting head 12, but the beveled surface 68 applies a variable amount of pressure on the coins with a greater amount of pressure on the inside edges of the coins. In this way, the beveled surface 68 helps to prevent the coins from bouncing off the wall 64 as the radial position of the coins is gradually decreased along the length of the gaging channel 58.

As the coins move along the gaging wall 64 of the gaging channel 58, the coins engage a gaging ramp 72 leading down to the lowermost surface 32. The gaging ramp 72 causes the coins to be firmly pressed into the pad 16 with their outermost edges aligned with the gaging radius provided by the gaging wall 64. At the terminal end of the gaging ramp 72, the coins are under the positive control of the sorting head 12. This ensures that the coins are held securely in the proper radial position determined by the gaging wall 64 as the coins approach the series of exit channels 20, 21, 22, 23, 24, and 25.

Beyond the gaging channel 58, the sorting head 12 forms the series of exit channels 20, 21, 22, 23, 24 and 25 which function as selecting means to discharge coins of different denominations at different circumferential locations around the periphery of the sorting head 12. Thus, the exit channels 20–25 are spaced circumferentially around the outer periphery of the sorting head 12, with the innermost edges of successive channels located progressively farther away from the common radial location of the outer edges of all coins for receiving and ejecting coins in order of increasing diameter. In the particular embodiment illustrated, the six channels 20–25 are positioned to eject successively dimes (channel 20), pennies (channel 21), nickels (channel 22), quarters (channel 23), Susan B. Anthony dollars (channel 24) and half-dollars (channel 25). The innermost edges of the exit channels 20–25 are positioned so that the inner edge of a coin of only one particular denomination can enter each channel; the coins of all other denominations reaching a given exit channel extend inwardly beyond the innermost edge of that particular channel so that those coins cannot enter the channel and, therefore, continue on to the next exit channel.

Typically, coin sorters operate by exerting pad pressure onto coins while those coins are within the exit channels of the coin sorter. Pad pressure is obtained because the exit channel is shallower than the thickness of the denomination corresponding to the exit channel. While in the exit channel, a coin under pad pressure is exposed to forces tending to maintain the radial position of the coin and urging the coin to move circumferentially along with the resilient pad. As such, coin sorters that apply pad pressure to coins within the exit channels can force coins from the proper exit channel, leading to a missort. Moreover, if the pad pressure on the coin forces the coin into the pad, the pad exerts a strong force in the direction of rotation onto the coin, not only tending to increase the possibility of the coin being forced under the wall of the exit channel, but also reducing the "overlap" between the edge of the coin and the exit channel wall further increasing the rate of missort due to the pad forcing a pad-pressured coin under the exit channel wall. Thus, potential inaccuracies are introduced into the sorting process by exposing the coins to pad pressure while the coins are within the exit channels. Additionally, applying pad pressure to those coins within the exit channels increases the wear on the pad as well as the sorting head.

Accordingly, in the present invention, each of the exit channels 20–25 acts as an exit chute for a particular coin denomination by disengaging that particular coin from pressed engagement with the pad 16 and releasing any pressure on the coin from contact with the sorting head 12. Therefore, each exit channel 20–25 is recessed from the lowermost surface 32 by a distance greater than the thickness of the coin denomination corresponding to the particular exit channel. After the coins have been released from pad pressure against the sorting head 12, the coins are free to move outwardly along the exit channel and exit into a coin receptacle due to the centrifugal and frictional forces acting on the coin. Additionally, in the case of an immediate stop from a predetermined number of coins of a certain denomination being sorted, the coins within the exit channel 20–25 continue moving outward along the exit channel, and some of the coins exit the exit channel as a result of the inertia of the coins. Immediate stopping minimizes coin "overage," and the coins within the exit channels at the time of stopping represent an acceptable level of coin "overage."

In order to sense the coins leaving the exit channels 20–25, conventional sensors 80–85, such as a quenched oscillator, are positioned at the periphery of the sorting head 12 and proximate to exit openings 20*a*–25*a* for the exit channels 20–25. Each sensor 80–85 provides an exit signal upon the discharge of a coin from the corresponding exit channel for the sensor. A series of counters 90–95 are responsive to these exit signals and thereby keep an accurate count of the sorted coins discharged from each exit channel. Each counter 90–95 may consist of a well-known counting device. When one of the counters 90–95 has detected a predetermined number of coins exiting through the exit opening of the exit channel corresponding to that particular counter, a predetermined condition exists, and the predetermined condition (i.e. a predetermined number of coins of a certain denomination has filled a coin receptacle) triggers the immediate stopping of the rotating disc 16. Upon immediately stopping, at least some of the coins entirely within an exit channel 20–25 are expelled from the exit channel by the inertia of the coins. In addition, any coins within the gaging channel 58 or not entirely within an exit channel 20–25 after leaving the gaging channel 58 maintain their position because those coins are under positive control.

Figure 3:
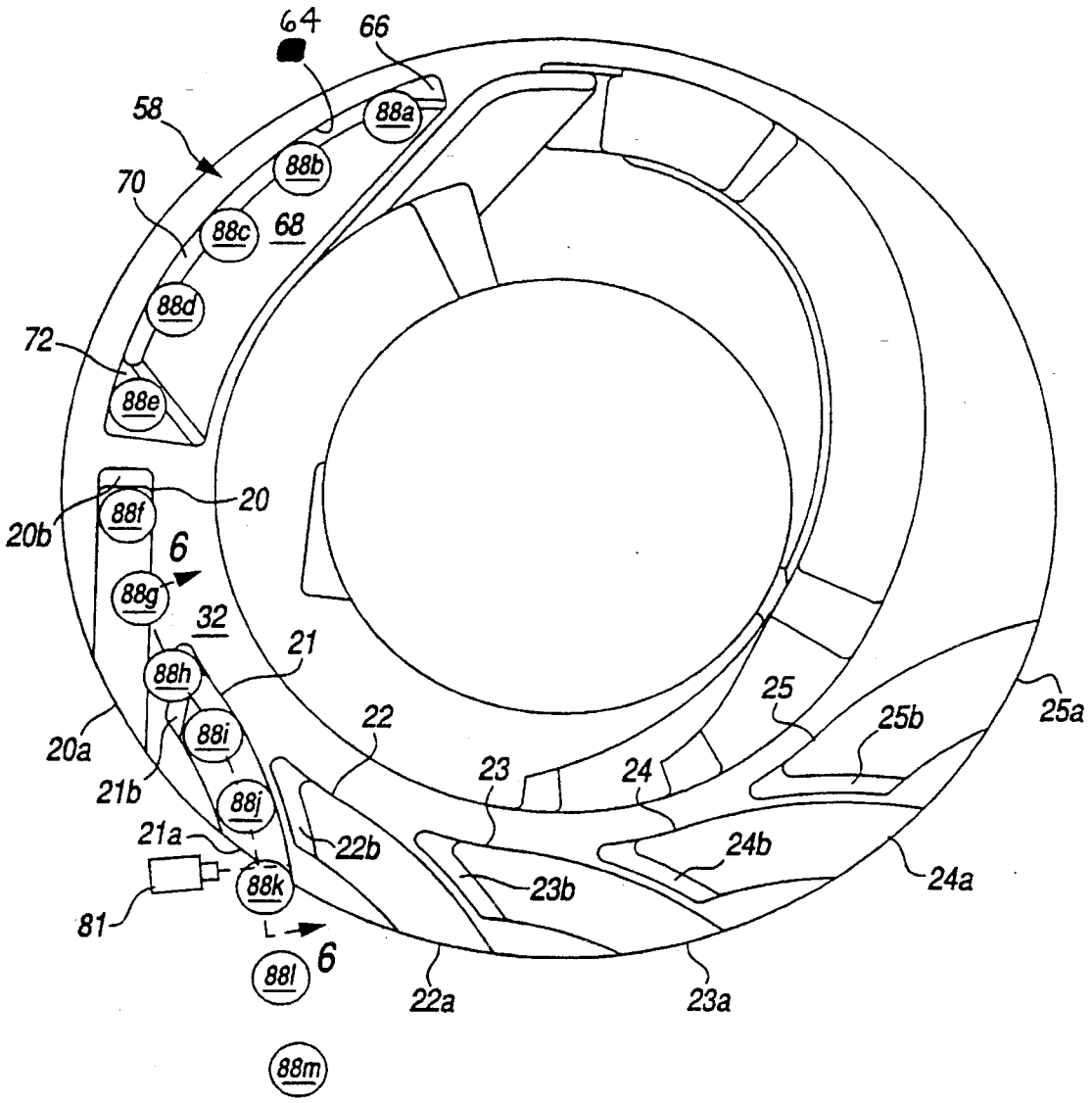
FIG. 3 shows the stationary sorting head of FIG. 2 with a stream of coins of the same denomination in the sorting path and exiting through an exit channel.

FIGS. 3–6 demonstrate the operation of the coin sorter apparatus of FIG. 1 utilizing pressureless exit channels 20–25 and immediate stopping in response to a predetermined condition such as a predetermined number of coins of a certain denomination being sorted. In FIG. 3, a stream of coins 88*a*–88*m* of the same denomination is passing through the coin sorter apparatus. The coin 88*a* has just entered the gaging channel 58 following coins 88*b*–88*d* in the gaging channel 58. As previously discussed, the gaging channel 58 allows the coins to move against the gaging wall 64 of the gaging channel 58. In this way, the gaging channel 58 and the gaging wall 64 realign the coins in the sorting path and position the outer edges of the coins at the proper radial position required for correct sorting.

The correctly radially aligned coin 88*e* follows the previously aligned coins 88*f*–88*m* from the gaging channel 58 to the peripheral area of the stationary disc 12 which has the exit channels 20–25. The coin 88*e* is engaging the ramp 72 which presses the coin 88*e* into a pressed engagement with the pad 16 to maintain the coin's correct radial position even if the coin sorter apparatus is stopped and restarted. The coins 88*f*–88*h* bypass the exit channel 20 because the diameter of the coins 88*f*–88*h* is larger than the width of the exit channel 20. As such, a portion of the coins 88*f*–88*h* remains under positive control because the coins 88*f*–88*h* remain in a pressed engagement between the pad 16 and the lowermost surface 32. Therefore, the radial position of the coins 88*f*–88*h* is maintained until these coins reach the exit channel 21. The exit channel 21 acts as an exit chute for the coin denomination of the coins 88*a* –88*m*. The coins 88*i*–88*m* have entirely entered the exit channel 21 and are disengaged from pressed engagement with the pad 16, releasing any pressure on the coins 88*i*–88*m* from the sorting head 12. After the coins have been released from the pad 16, they are no longer under positive control. Consequently, the coins freely move outwardly along the exit channel 21 and exit through the exit opening 21*a* into a coin receptacle as a result of the centrifugal and frictional forces acting on the coins.

Figure 6:
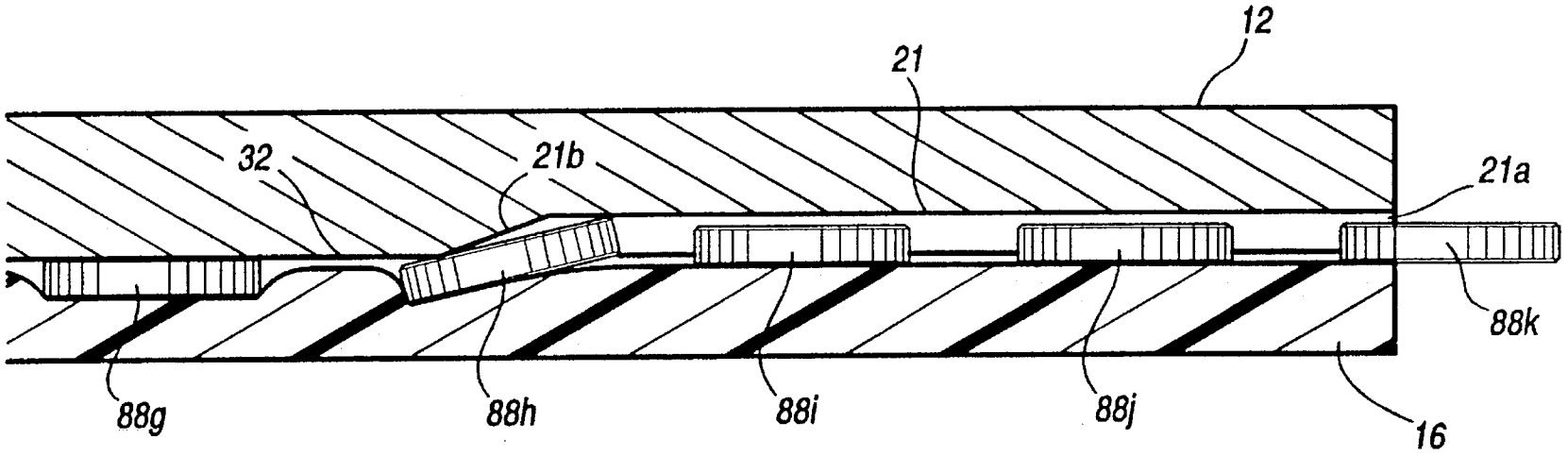
FIG. 6 is a cross-sectional view of the coin sorting apparatus taken along line 6—6 of FIG. 3.

FIG. 6 shows a cross-sectional view of the sorting path taken along the line 6—6 of FIG. 3. As illustrated, the coin 88*g* is in pressed engagement between the pad 16 and the lowermost surface 32. Because of this pressed engagement with the pad 16, the coin 88*g* remains at the same radial position until it encounters the exit channel 21. The coin 88*h* has encountered an exit ramp 21*b* . Each recess 20–25 is illustrated with a corresponding exit ramp 20*b*–25*b*. The exit ramp 21*b* bridges the lowermost surface 32 and the exit channel 21 to gradually release the pad pressure on the coin 88*h* as it begins entering the exit channel 21. This gradual release of pressure prevents the coin from bouncing within the exit channel 21. As illustrated, a portion of the coin 88*h* remains in a pressed engagement with the resilient pad 16 and the lowermost surface 32. The coins 88*i*–88*k* precede the coin 88*h* in the sorting path. The coins 88*i*–88*k* are entirely within the exit channel 21 and are disengaged from a pressed engagement with the sorting head 12. The coins 88*i*–88*k* are free to move outwardly and exit the exit channel 21 due to the centrifugal and frictional forces acting on the coins 88*i*–88*k*.

After a predetermined number of coins is counted by the counter 91 corresponding to the exit channel 21, a predetermined condition exists requiring the immediate stopping of the rotating disc 13 to stop the sorting process. As shown in FIG. 1, the counters 90–95 respond to exit signals from the sensors 80–85 and are coupled to a braking mechanism 98*a*. The braking mechanism 98*a* includes control circuitry 100*a* responsive to a signal from the counters 90–95 triggering the braking mechanism 98*a* to immediately stop the rotating disc 13. The immediate stopping of the rotating disc 13 can be accomplished in a number of ways known to someone skilled in the art. For example, the braking mechanism 98*a* can include a brake assembly 102 coupled to the electric motor 14. Upon receiving the immediate stopping signal from one of the counters 90–95, the control circuitry 100*a* of the braking mechanism 98*a* can immediately stop the rotating disc 13 by triggering the immediate application of the brake assembly 102 to the electric motor 14. Preferably, the control circuitry 100*a* also signals a motor control circuit 101 to trigger the simultaneous de-energizing or stopping of the electric motor 14.

Alternatively, the immediate stopping of the rotating disc 13 can involve a braking mechanism (not shown) that includes a brake assembly (not shown) and a clutch assembly (not shown). The coin sorter apparatus of the present invention has a drive mechanism (not shown), including the stub shaft, that is mechanically coupled to both the electric motor 14 and the rotating disc 13 to enable the electric motor 14 to rotate the rotating disc 13. Upon receiving the signal from one of the counters 90–95 that a predetermined number of coins of a particular denomination have been sorted, control circuitry 100*c* for the alternative braking mechanism (not shown) immediately stops the rotating disc 13 by triggering the immediate application of the alternative brake assembly (not shown), such as a conventional disc brake assembly, to the drive mechanism. Simultaneous to the triggering of the brake assembly, the control circuitry 100*c* can also trigger the clutch assembly (not shown) that is engaged to the drive mechanism. Once triggered, the clutch assembly disengages the drive mechanism from the electric motor 14 to facilitate the immediate stopping of the rotating disc 13 by the brake assembly.

Another alternative for immediately stopping the rotating disc 13 has a braking mechanism 98*b* including control and drive circuitry 100*b* coupled to the electric motor 14. Upon receiving the signal from one of the counters 90–95 that a predetermined number of coins of a particular denomination have been sorted, the control and drive circuitry 100*b* for the braking mechanism 98*b* can reverse bias the electric motor 14 to immediately stop the rotating disc.

Figure 4:
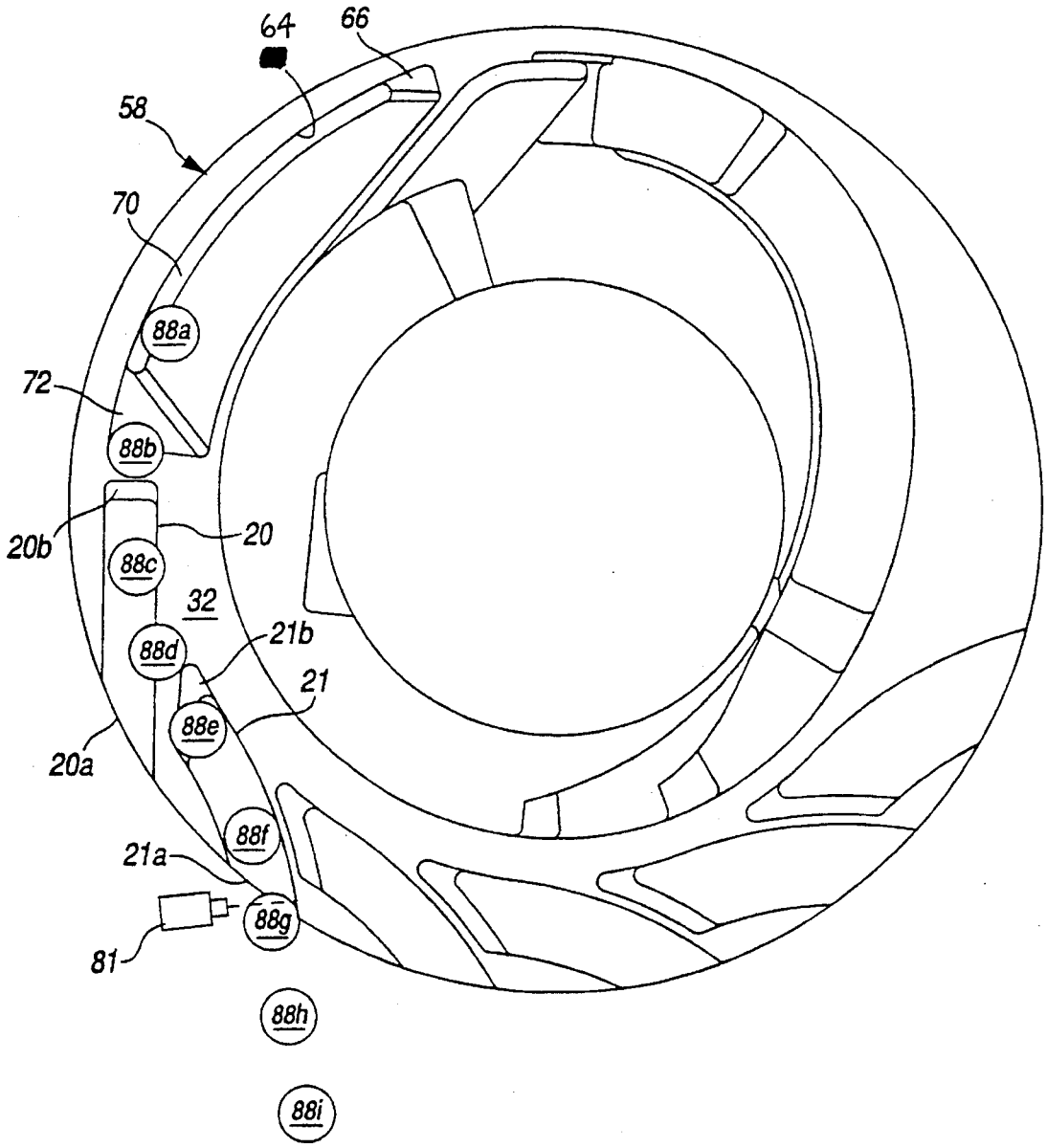
FIG. 4 shows the stationary sorting head of FIG. 3 at the time that a predetermined condition exists, and the braking mechanism stops the rotating disc.

FIG. 4 shows the coins 88*a* –88*i* of FIG. 3 further along in the sorting path at the moment when the counter 91 detects that a predetermined number of coins has exited through the exit opening 21*a* of the exit channel 21. The coins 88*h*–88*i* have already exited the exit channel 21 through the exit opening 21*a*. The coins 88*j*–88*m* of FIG. 3 do not appear in FIG. 4 because those coins have exited into the coin receptacle.

Figure 5:
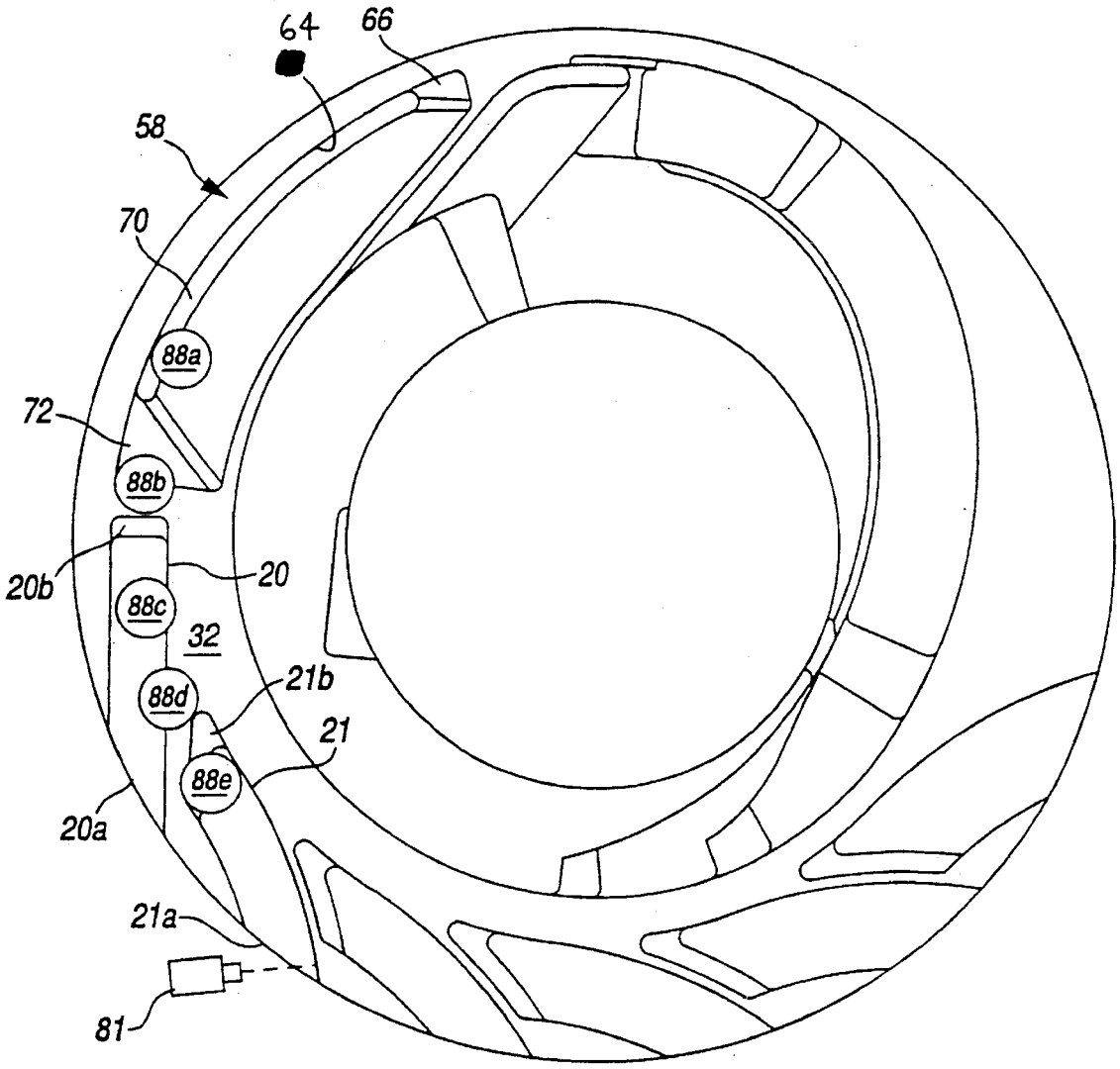
FIG. 5 shows the stationary sorting head of FIG. 4 after the coins are discharged from the exit channel as a result of inertia.

In response to the signal from the counter 91 that a predetermined number of coins of the denomination corresponding to exit channel 21 has been sorted, the braking mechanism immediately stops the rotation of the rotating disc 13. At that time, the coins 88*f*–88*g* are within the exit channel 21 and free from any pressed engagement with the sorting head 12. These coins 88*f*–88*g* therefore are free to move outwardly along the exit channel 21 and, as shown in FIG 5, have exited the exit recess 21 as a result of the inertia of each coin 88*f*–88*i*. Meanwhile, the coins 88*b*–88*e* remain in a pressed engagement with the sorting head 12 and, thus, maintain their position in the sorting path. At the time of stopping, the coin 88*a* is within the gaging channel 58 and under positive control. As such, the coin 88*a* also tends to remain in its position within the gaging channel 58.

The coin sorter apparatus of the present invention has been specifically described with the sorting head 12. The stationary sorting head of the present invention, however, can take a variety of different forms. For example, the present invention can include a sorting head that guides coins towards the exit channels at the periphery of the sorting head utilizing channels with converging walls to guide the coins to the exit channels. Additionally, many apparatus and methods for immediately stopping the rotating disc 13 are known in the field, and additional methods and apparatus for the immediate stopping of the rotating disc 13 are available in addition to the three alternative braking mechanisms specifically mentioned. A major inventive aspect of the present invention being the utilization of exit channels that do not apply pressure to the coins within and, upon the occurrence of a predetermined condition, the immediate stopping of the rotating disc such that the coins within the exit channels are discharged from the coin sorter due to the inertia of the coins.

Thus, the coin sorter apparatus utilizing pressureless exit recesses 20–25 together with immediate stopping provides a simpler coin sorting apparatus that is easier to manufacture and more inexpensive than other methods of terminating the sorting process. The present invention accomplishes this with an acceptable level of overage of sorted coins and reduces inaccuracies and missorts present in coin sorters utilizing pressurized exit channels.

What is claimed is:

1. A coin sorter apparatus for sorting a group of mixed coins by denomination and immediately terminating the sorting process, said apparatus comprising:

a rotatable disc having a first surface for receiving said mixed coins;

means for rotating said disc;

a stationary sorting head having a lower surface parallel to said first surface of said rotatable disc and spaced slightly therefrom for guiding said mixed coins along a sorting path;

a central opening of said stationary sorting head for allowing coins to be received onto said first surface of said rotatable disc;

a queuing area on the underside of said sorting head including a queuing channel for selectively directing the rotating mixed coins into a sorting path, said queuing area allowing continued rotation of the mixed coins on the first surface of said rotating disc;

a gaging area on the underside of said stationary sorting head including a gaging channel for receiving coins from said queuing area in a single file configuration and manipulating the radial position of each denomination of said coins;

an exit area on the underside of said stationary sorting head including a plurality of exit channels for receiving said coins from said gaging area and allowing rotating coins positioned at radial positions determined by said gaging channel to exit said coin sorter apparatus through an exit opening for each of said exit channels along the periphery of said stationary sorting head, each said exit channels releasing any coins entering said exit channel from the pressure of said underside of said sorting head and thereby permitting outward movement of coins within said exit channels;

a plurality of exit sensors located at said exit openings of said exit channels, said exit sensors being responsive to the exiting of coins through said exit openings and providing exit signals in response to the exiting of coins, said exit sensors being coupled to counters, said counters being responsive to said exit signals for keeping accurate count of coins leaving the sorter apparatus at each of said exit openings, each of said counters providing a counter signal upon reaching a predetermined number; and a stopping mechanism responsive to said counter signal for immediately stopping the rotation of the rotatable disc while continuing the movement of coins along said sorting path and said channels during the stopping of said disc.

2. A coin sorter apparatus for sorting a group of mixed coins by denomination and immediately terminating the sorting process, said apparatus comprising:

a rotatable disc having a first surface for receiving said mixed coins;

means for rotating said disc;

a stationary sorting head having a lower surface parallel to said first surface of said rotatable disc and spaced slightly therefrom for guiding said mixed coins along a sorting path;

a central opening of said stationary sorting head for allowing coins to be received onto said first surface of said rotatable disc;

a queuing area on the underside of said sorting head including a queuing channel for selectively directing the rotating mixed coins into a sorting path, said queuing area allowing continued rotation of the mixed coins on the first surface of said rotating disc;

a gaging area on the underside of said stationary sorting head including a gaging channel for receiving coins from said queuing area in a single file configuration and manipulating the radial position of each denomination of said coins;

an exit area on the underside of said stationary sorting head including a plurality of exit channels for receiving said coins from said gaging area and allowing rotating coins positioned at radial positions determined by said gaging channel to exit said coin sorter apparatus through an exit opening for each of said exit channels along the periphery of said stationary sorting head, each said exit channels releasing any coins entering said exit channel from the pressure of said underside of said sorting head and thereby permitting outward movement of coins within said exit channels;

a plurality of exit sensors located at said exit openings of said exit channels, said exit sensors being responsive to the exiting of coins through said exit openings and providing exit signals in response to the exiting of coins, said exit sensors being coupled to counters, said counters being responsive to said exit signals for keeping accurate count of coins leaving the sorter apparatus at each of said exit openings, each of said counters providing a counter signal upon reaching a predetermined number; and a stopping mechanism responsive to said counter signal for immediately stopping the rotation of the rotatable disc without interrupting the movement of coins along said sorting path and said exit channels during the stopping of said disc.

* * * * *